US005687599A

United States Patent [19]

Donaldson et al.

[11] Patent Number: 5,687,599

[45] Date of Patent: Nov. 18, 1997

[54] METHOD OF FORMING A CAN WITH AN ELECTROMAGNETICALLY FORMED CONTOURED SIDEWALL AND NECKED END

[75] Inventors: Roger H. Donaldson, Lancaster County; Horst F. Arfert, Chesterfield County; Daniel F. Cudzik, Chesterfield County; Robert P. Foetisch, Chesterfield County, all of Va.

[73] Assignee: Reynolds Metals Company, Richmond, Va.

[21] Appl. No.: 582,714

[22] Filed: Jan. 4, 1996

[51] Int. Cl.[6] ..... B21D 26/14; B21D 19/12

[52] U.S. Cl. ..... 72/62; 72/56; 72/84

[58] Field of Search ..... 72/54, 56, 84, 72/105, 106, 62

[56] References Cited

U.S. PATENT DOCUMENTS

| | | | |
|---|---|---|---|
| 2,976,907 | 3/1961 | Harvey et al. . | |
| 3,236,080 | 2/1966 | Illgen . | |
| 3,376,633 | 4/1968 | Wesley . | |
| 3,412,188 | 11/1968 | Seefluth . | |
| 3,461,699 | 8/1969 | Roth | 72/56 |
| 3,599,461 | 8/1971 | Astl | 72/56 |
| 3,618,350 | 11/1971 | Larrimer et al. | 72/56 |
| 3,628,451 | 12/1971 | McClellan | 101/4 |
| 3,691,267 | 9/1972 | Takehara . | |
| 3,810,372 | 5/1974 | Queyroix . | |
| 3,810,373 | 5/1974 | Queyroix . | |
| 3,975,936 | 8/1976 | Baldwin et al. . | |
| 4,034,036 | 7/1977 | Farrell . | |
| 4,120,924 | 10/1978 | Rainville . | |
| 4,563,887 | 1/1986 | Bressan et al. | 72/84 |
| 4,617,077 | 10/1986 | Giese et al. . | |
| 4,781,047 | 11/1988 | Bressan et al. | 72/84 |
| 4,898,708 | 2/1990 | Holoubek et al. . | |
| 4,947,667 | 8/1990 | Gunkel et al. . | |
| 5,058,408 | 10/1991 | Leftault, Jr. et al. . | |
| 5,245,848 | 9/1993 | Lee, Jr. et al. | 72/84 |
| 5,275,033 | 1/1994 | Riviere | 72/62 |
| 5,353,617 | 10/1994 | Cherian et al. . | |

FOREIGN PATENT DOCUMENTS

| | | |
|---|---|---|
| 60-106628 | 6/1985 | Japan . |

*Primary Examiner*—David Jones
*Attorney, Agent, or Firm*—Robert C. Lyne, Jr.

[57] ABSTRACT

A can is formed including a body having a bottom wall with an electromagnetically formed contoured sidewall extending therefrom and a necked end. The open end of the sidewall is first pre-necking to form a reduced diameter section. Thereupon, the sidewall is electromagnetically formed to form an outwardly expanding contoured sidewall. The can is then subjected to a necking process proximate the reduced diameter section to achieve a further reduced diameter conical necked end. The necking process may be performed by radially inwardly advancing an external forming member into contact with the sidewall against counterpressure provided by a pair of relatively axially displaceable inner members disposed within the can interior. Alternatively, the necking process may be spin flow necking.

24 Claims, 5 Drawing Sheets

METHOD OF FORMING A CAN WITH AN ELECTROMAGNETICALLY FORMED CONTOURED SIDEWALL AND NECKED END

TECHNICAL FIELD

The present invention relates generally to manufacturing containers or cans for beverages such as soft drinks, beer, and juices, and, more particularly, to a method of forming a can with an electromagnetic formed contoured sidewall and a necked end.

BACKGROUND ART

Beverages such as soft drinks, beer, tea, juice, water, concentrate, or the like, are commonly sold in metal cans. A typical can includes a bottom wall, often of an inwardly disposed concave dome shape, and a cylindrical sidewall extending from the bottom wall and terminating in a necked end to which a can end is secured. The end includes a closed score line formed with an easy-open, stay-on tab secured to the end at a location immediately outside a portion of the score line by a fastener such as a rivet. The sidewall of these metal container bodies are sometimes formed utilizing a drawing and ironing (D&I) process as is well known. In the beer and beverage industry, such containers have a nominal can diameter of, for example, two and eleven sixteenths inches (called a "211 can" using can maker's conventional terminology) and, after being filled with beverage, the open end is sealed with the can end. Prior to filling, the open end is necked-in, for example, to a neck diameter of 206 (two and six sixteenths inches) on the standard 211 can or possibly even to a 204 neck (two and four sixteenths) or a 202 neck.

One purpose of necking in the can open end is to allow the use of a smaller diameter end which is secured to the necked-in opening after the can has been filled, this securing being done by deforming the end flange of the can body together with a peripheral cover hook of the can end so as to form a double seam. The neck enables the flange, and therefore the can end, to be of smaller diameter than if there were no neck which means further metal reduction and thereby cost savings in metal. Necking also minimizes the radial extent of the flange which is formed at the end of the necked-in portion and thus helps to resist flange cracking. The neck may also provide a convenient way for a carrier to engage a plurality of cans.

There are various ways of necking a beverage can. One known method involves the use of static necking dies wherein the can is conveyed through a number of stations. At each station, a die ring is relatively reciprocated into contact with the open end while the can bottom is non-rotatably held with a base pad assembly. At each successive station, the static necking die is of progressively smaller diameter to progressively neck the can to the desired diameter. This process requires the D&I can to have an axial or column strength of at least 200 lbs.

Other necking methods involve rolling or spinning the neck and/or flange, using an external spinning roll cooperating with an internal member within the can body. In these methods, the can body is supported rigidly by an internal mandrel or the like. The internal member may be a spinning roll, pilot, or mandrel supporting the can body. In one such method, the neck and flange are formed simultaneously in a can body supported internally and rigidly by a mandrel or chuck of an expanding/collapsing type, the neck and flange profile being formed by external spinning rolls cooperating with this mandrel.

In another such method, the can body is supported internally by an anvil and endwise by a spinning pilot; the neck and flange are formed by a profiled, external spinning roll which deforms the can body into a groove on the pilot and anvil, and the roll is moved axially of the can body.

A spin flow necking process is disclosed in U.S. Pat. No. 4,781,047, issued Nov. 1, 1988 to Bressan et al, which is assigned to Ball Corporation and is exclusive licensed to the assignee of the present application, Reynolds Metals Company, Richmond, Va. The disclosure of this patent is hereby incorporated by reference herein in its entirety. Spin flow necking is a process where an external free roll is moved radially inward and axially against the outside wall of the open end of a rotating trimmed can to form a conical neck at the open end thereof. An axially movable spring loaded holder and an axially fixed eccentric roll support the interior wall of the can; the holder moves axially away from the eccentric roll under the forming force of the inwardly advancing forming roll. This is a single operation where the can rotates and the free roll rotates such that a smooth conical necked end is produced. In practice, the can is then flanged. The term "spin flow necking" as used in this application refers to such processes and apparatus, the essential difference between spin flow necking and other types of spin necking being the axial movement of both the external roll and the internal holder in cooperation with the axially immovable eccentric roll.

To maximize cost savings in metal, today's beverage cans are made with a sidewall thickness of as low as 0.003 inch without compromising the column strength, i.e., the axial strength of the sidewalls, of the can. It is also advantageous to further minimize the size of the can end by pre-necking the sidewall of the can prior to performing the spin flow necking process. The pre-necking process can be accomplished by the static die necking process described above. The resulting smaller diameter sidewall is then subjected to the spin flow necking process to achieve the desired necking diameter. Pre-necking the can prior to the spin flow necking process results in a smaller necking diameter than otherwise would be achievable by performing the spin flow necking process on a can with a straight sidewall.

Typically, the exterior surface of the can sidewall is printed with advertising and other information, for instance, nutrient content of the beverage as mandated by federal statute. The interior surface has a clear coating that prevents the can contents from chemically interacting with the metal sidewalls.

For aesthetic reasons, it is considered further desirable to mechanically deform selected areas of the exterior wall in various ways to enhance their appearance and thereby attract a potential purchaser. It is known to form or shape cans by embossing the sidewalls of such cans in various aesthetically appealing patterns which may comprise marks or outlines associated with a particular beverage and company, as disclosed for example in U.S. Pat. No. 3,628,451 to McClellan et al., entitled "Apparatus For and Method Of Shaping Workpieces," the contents which is incorporated herein by reference.

An alternative method for expanding the sidewall of a can using electromagnetic forces is disclosed in U.S. Pat. No. 4,947,667 to Gunkel et al., entitled "Method and Apparatus For Forming a Container," the contents of which is also incorporated by reference. In electromagnetic forming, a magnetic field of relatively high intensity is formed by passing an electric current through a constant diameter coil consisting of a conductive wire which is typically supported by a nonconductive structure. The coil is inserted into the constant diameter can interior through the open end in close, yet radially spaced proximity to the can sidewall. The current produces a pulsed magnetic field which induces a current in the adjacent conductive can. The induced current in the workpiece reacts with the magnetic field to produce a force which is directed against the adjacent can sidewall, forming it to deform radially outward.

The prior art methods of contouring the sidewall of the container results in a container having a reduced column strength, thereby precluding the possibility of both performing the pre-necking process on a contoured can and obtaining the required necked-in dimensions. Performing the electromagnetic embossing process on a can which has completed the spin flow necking process is also ineffective. This is because after spin flow necking, the inner diameter of the neck is significantly smaller than the inner diameter of the sidewall of the can. Because the diameter of the coil to be inserted into the can is determined by the inner diameter of the neck, the distance between the sidewall and the coil increases as the diameter of the neck decreases. Because the strength of the electromagnetic forces acting on the can body is adversely affected by an increasing distance between the sidewall and the coil, the electromagnetic embossing process is ineffective for use on a can which has completed the spin flow necking process.

DISCLOSURE OF THE INVENTION

It is accordingly an object of the invention to provide an improved method of forming a can with a contoured sidewall and a necked-in end appropriate for securing an end thereon.

Another object of the invention is to provide an improved method of contouring the sidewall of a can without sacrificing the final necked-in diameter of the open end.

A further object of the invention is to provide an improved beverage can including a electromagnetically formed contoured sidewall with the desired final necked-in diameter of the open end.

These and other objects are achieved by the method of forming a can of the present invention.

According to the present invention, a method of manufacturing a metal container is disclosed. The metal container includes a body having a bottom wall with a cylindrical sidewall extending therefrom and having an open end. The method includes the steps of pre-necking the open end of the sidewall to form a reduced diameter section. The sidewall is then electromagnetically formed to form an outwardly expanding contoured sidewall, whereupon necking is performed proximate the reduced diameter section to achieve a further reduced diameter conical necked end by radially inwardly advancing an external forming member into contact with the sidewall against counterpressure provided by a pair of relatively axially displaceable inner members disposed within the can interior.

In a preferred embodiment, the method further comprises the step of flanging the necked end of the can.

More specifically, the step of electromagnetic forming comprises the steps of placing the body inside a mold with the can bottom resting on a bottom surface of the mold. A coil of electrically conductive material is placed inside the body with the outer diameter of the coil adjacent inside surfaces of the sidewall. The air disposed between the body and the mold is removed to create a vacuum, whereupon the coil is energized to create an electromagnetic force sufficient to expand a portion of the sidewall located adjacent the coil outwardly into the mold. In this process, the outer diameter of the coil is less than the diameter of the reduced diameter section.

Also more specifically, the step of pre-necking is formed by a die necking process. The die necking process comprises the steps of conveying the can through at least one station where a die ring is reciprocated into contact with the open end while the can bottom is non-rotatably secured. Alternatively, the can may be conveyed through a number of stations where, at each station, a die ring of a progressively smaller diameter is reciprocated into contact with the open end while the can bottom is non-rotatably secured.

In another preferred embodiment, the step of necking to achieve a further reduced diameter conical necked end is performed by spin flow necking, in which case the spin flow necking comprises positioning the can with the can bottom in contact with a base spindle assembly and the open end on a necking spindle assembly, spinning the body by rotating the necking and base spindle assemblies about a common axes of rotation, and moving an external free roll inwardly and axially against the open end against a spring loaded holder supporting the interior wall of the can to form the conical necked end, the holder being free to move axially under the forming force of the free roll. Preferably, the can is positioned with the can bottom in suction contact with the base spindle assembly.

According to another aspect of the invention, prior to the step of electromagnetic forming, the method includes the step of printing an outer surface of the sidewall.

Alternatively, prior to the step of electromagnetic forming, the method includes the step of coating an inner surface of the body.

According to a further aspect of the invention, prior to the step of pre-necking, the method includes the step of coating an inner surface of the body.

In yet another aspect of the invention, prior to the step of pre-necking, the method includes the step of varying the thickness of the sidewall. The thickness of the sidewall is varied during the drawing and ironing process by tapering the punch.

Further according to the present invention, a metal container is disclosed, including a bottom wall and a pre-necked, electromagnetically formed, spin-necked sidewall extending upwardly from the bottom wall in a selectively contoured shape and terminating in a necked end.

Preferably, the bottom wall is of an inwardly disposed concave dome shape, and the pre-necked, electromagnetically formed, spin-necked sidewall includes at least one contoured surface.

Also preferably, the necked end is conical and terminates in a flange.

According to a further embodiment of the present invention, a method of manufacturing a metal container is disclosed. The container includes a body having a bottom wall with a cylindrical sidewall extending therefrom and having an open end. The method comprises the steps of electromagnetic forming the sidewall to form an outwardly expanding contoured sidewall, and performing necking to achieve a reduced diameter conical necked end by radially inwardly advancing an external forming member into contact with the sidewall against counterpressure provided by a pair of relatively axially displaceable inner members disposed within the can interior.

Preferably, the necked end of the can is flanged.

More specifically, the step of electromagnetic forming comprises the steps of placing the body inside a mold with the can bottom resting on a bottom surface of the mold, placing a coil of electrically conductive material inside the body with the outer diameter of the coil adjacent inside surfaces of the sidewall, removing air disposed between the body and the mold to create a vacuum, and energizing the coil to create an electromagnetic force sufficient to expand a portion of the sidewall located adjacent the coil outwardly into the mold.

According to the invention, the outer diameter of the coil is less than the diameter of the reduced diameter section.

According to a preferred embodiment, the step of necking is performed by spin flow necking. The spin flow necking process includes the steps of positioning the can with the can bottom in contact with a base spindle assembly and the open end on a necking spindle assembly, spinning the body by rotating the necking and base spindle assemblies about a common axes of rotation, and moving an external free roll inwardly and axially against the open end against a spring loaded holder supporting the interior wall of the can to form the conical necked end, the holder being free to move axially under the forming force of the free roll.

Preferably, the can is positioned with the can bottom in suction contact with the base spindle assembly.

Preferably, prior to the step of electromagnetic forming, the method includes the step of printing an outer surface of the sidewall, and/or the step of coating an inner surface of the body.

BEST MODE FOR CARRYING OUT THE INVENTION

Figure 1:
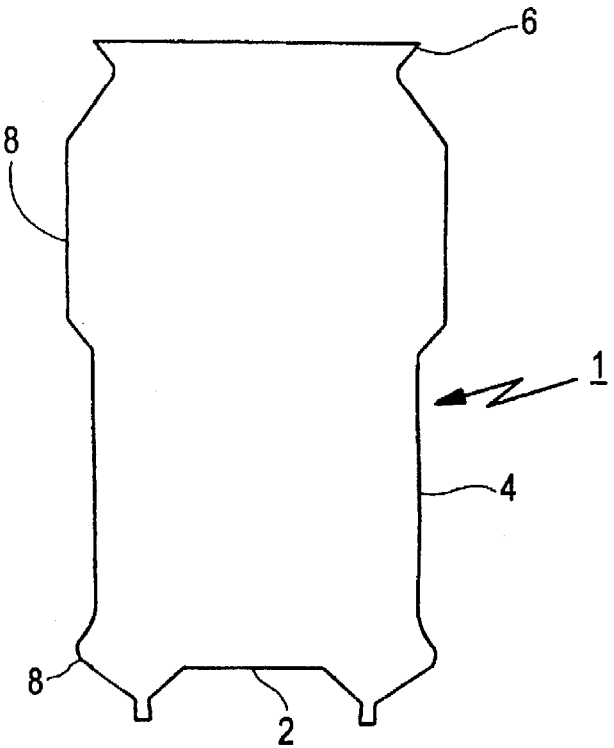
FIG. 1 is a side view of the can formed according to the present invention.

FIG. 1 of the drawings depicts a uniquely featured can 1 formed according to the method of the present invention. Can 1 includes a conventional bottom wall 2 of an inwardly disposed concave dome shape. Sidewall 4 extends from the bottom wall 2 and terminates in necked-in opening 6. According to the method of the present invention, sidewall 4 includes various contour surfaces 8, as may be determined by the particular application of the can. As used in this application, the term "contour surface" refers to any desired surface of a outwardly curving form. Contour surfaces 8 may comprise, for instance, various protuberances to provide an aesthetically pleasing can. Contour surfaces 8 may also comprise marks or outlines associated with a particular beverage or company. Contour surfaces 8 are formed by electromagnetic forming, as described in detail below. In accordance with the unique features discussed below, necked-in opening 6 is significantly smaller than the straight sidewall 4, as can be achieved by performing spin flow necking on the contoured can after pre-necking of the straight sidewall.

Figure 2:
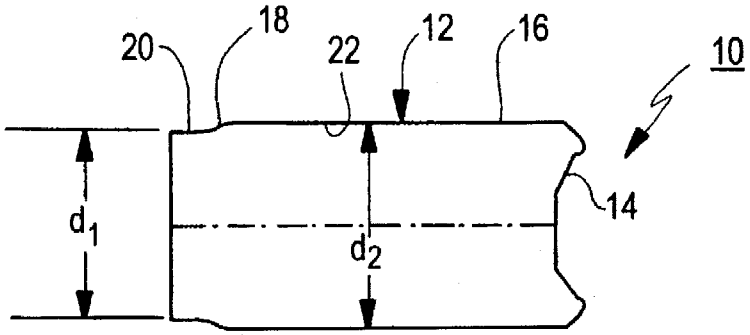
FIG. 2 is a view of the end of a can after the pre-necking step.

Referring to FIG. 2 of the drawing, body 12 of can 10 is depicted including a bottom 14 having cylindrical sidewall 16 extending therefrom, preferably formed utilizing a drawing and ironing (D&I) process as is well known. The D&I process results in a can having a sidewall of a substantially constant diameter. Prior to the pre-necking process, the can may be decorated or printed, as required. Furthermore, the inner surface 22 may be coated as dictated by the particular application.

As depicted in FIG. 2, conical transition segment 18 is formed between open end 20 and sidewall 16 such that the diameter $d_1$ of open end 20 is smaller than diameter $d_2$ of sidewall 16. Reduced diameter open end 20 is formed by a static die pre-necking process as described earlier. The resulting can is depicted in FIG. 2. At the time of pre-necking, the constant diameter sidewall is capable of resisting the substantial column loads imposed by static die necking or similar processes.

Figure 3:
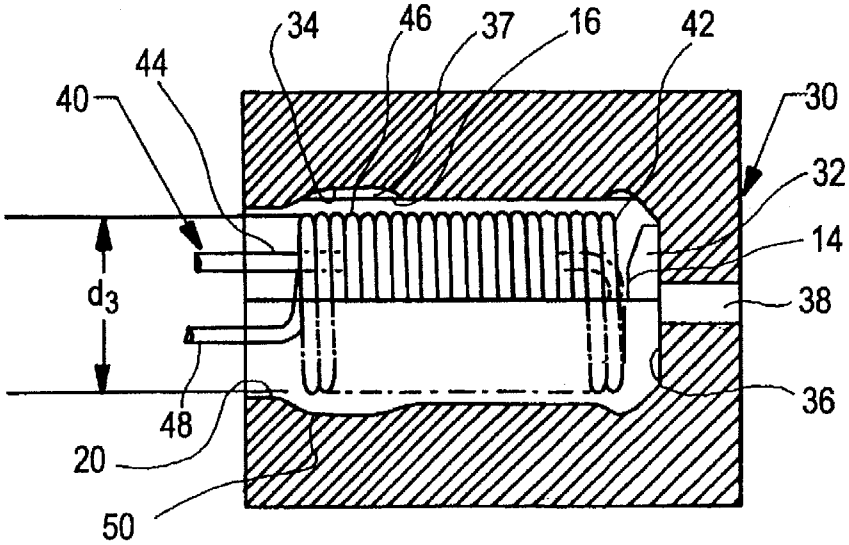
FIG. 3 is a cross-sectional view of the can in position during the electromagnetic forming process, with the top half of the can depicted prior to forming, and the bottom half of the can depicted after forming.

Referring to FIG. 3, coil 40 is used to exert an electromagnetic force sufficient to contour sidewall 16. In its preferred embodiment, the coil 40 has a central body, not shown, made of a plastic material and providing structural support for the coil. The central body includes a central axial hole in the middle thereof. The coil 40 includes a tubing 42 made of an electrically conductive material, preferably beryllium copper. A central portion 44 of tubing 42 is first fed through the central axial hole in the body, then tubing 42 is wrapped around the body in a spiral manner to form the coil windings 46. At the end of the coil windings 46, tubing 42 terminates in conductor portion 48, with the end **44*a* of central portion 44 and conductor portion 48** being connected to a power supply, not shown, to permit energization of the coil. Preferably, the power supply is a capacitor to permit almost instantaneous energization of the coil to approximately 10,000 amps in microseconds.

In the present invention, coil 40 is inserted into the body 12 as depicted in FIG. 3. The coil 40 is disposed so that the coil windings 46 are adjacent to the sidewall 16 of the can body. Preferably, the coil 40 does not touch the can bottom 14 or the pre-necked open end 20 to avoid contamination of the inside coating as well as short circuiting.

It will be appreciated that, to permit insertion of the coil into body 12 without contacting open end 20, the outside diameter $d_3$ of the coil windings 46 must be less than the inner diameter $d_1$ ($d_3<d_1$) of open end 20. Accordingly, the extent to which open end 20 is pre-necked during the die necking process determines the distance between the outer diameter $d_3$ of the coil windings 46 and the inside diameter $d_2$ of the sidewall 16. This distance ($d_2-d_3$) dictates the strength of the electromagnetic force emanating from coil 40 and acting on sidewall 16.

Can body 12 is placed into cavity 32 of a non-conductive mold 30. The inner surface 34 of cavity 32 is contoured to the desired finished contour of the can. The can 10 is placed into mold 30 with the bottom surface 14 of can 10 resting on bottom surface 36 of the mold. It will be appreciated by one of ordinary skill in the art that mold 30 may be made of two or more segments secured to one another. Typically, the segments of the mold are secured after the can is placed inside the mold.

The desired forming of sidewall 16 is achieved by the application thereto of an intense electromagnetic field produced by the discharge of electrical energy into the coil 40. The force thus generated drives the sidewall 16 against mold 30, thus pushing the sidewall against the contour of cavity inner surface 34 to form contoured sidewall 50. This action is almost instantaneous, and for this reason, it is necessary to evacuate the air from the space 37 between the sidewall 16 and the inner surface 34. Otherwise, the entrapped air cannot escape and is compressed with extremely high pressure and temperature by the advancing metallic article being accelerated by the magnetic field, thereby causing defects in the formed shaped, such as bubbles and deformed surfaces. For this reason, a vacuum hole 38 is provided in mold 30, into which a conduit is inserted, the conduit leading to a vacuum pump or the like to permit evacuation of the air trapped in space 37. Once the electromagnetic force has been supplied by coil 40, the can 10 with contoured sidewall 50 is released from the mold.

Figure 4:
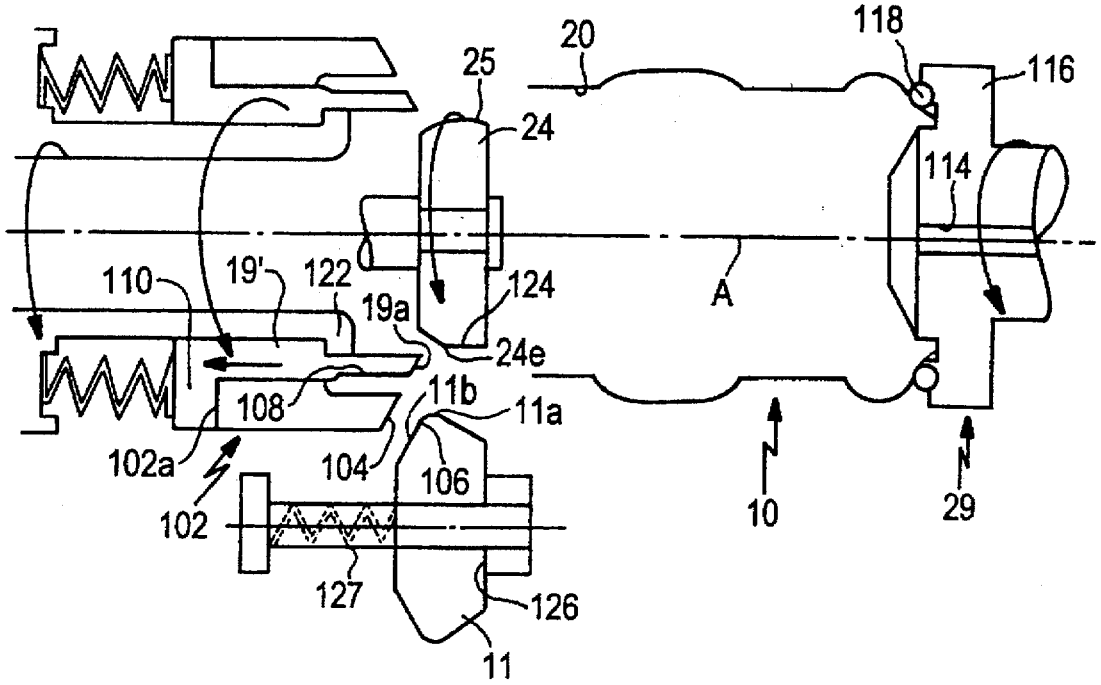
FIG. 4 is a schematic representation of a spin flow necking apparatus in accordance with the present invention.

The contoured can is next subjected to the spin flow necking process, depicted in FIGS. 4–10. This process is described in detail in U.S. Pat. No. 5,245,848 by Harry W. Lee, Jr. et al, entitled "Spin Flow Necking Cam Ring," issued on Sep. 21, 1993, and assigned to the assignee of the present application, Reynolds Metals Company, the disclosure of which is incorporated by reference herein in its entirety. Generally, in the spin flow necking process, an externally located free spinning forming roll 11 is moved inward and axially against the outside wall of the open end 20 of the rotating can 10 to form a conical neck. As disclosed in the aforesaid patent and as schematically depicted in FIG. 4, a spring-loaded holder or slide roll 19' supports the interior wall of the can 10 and moves axially under the forming force of the free roll 11. This is a single operation where the can rotates and the free roll 11 rotates so that a smooth conical necked end is produced.

More specifically, the container bottom 14 is loaded onto the base pad assembly 29 which retains the container 10 by vacuum applied in a known manner through a central hole 114. The container 10 is located on a raised circular plug 116 inside the countersink diameter of the bottom. An airtight seal is maintained on the outside tapered surface of the container bottom 14 with an elastic seal 118. The base pad assembly 29 is axially movable to advance the container into the tooling for forming and to remove the finished can for transfer to a flanging operation. The base pad is rotated by a main drive (not shown) and provides most of the rotative force on the container during the forming process.

Cam ring 102 in the form of a cylindrical member has a conical face 104 extending at the same angle as the conical forming surface **19*a* on the slide roll 19' in spaced, radially outward adjacent relationship, such that the conical face or cam follower surface 104 contacts the conical lead portion 11*b* of the form roll 11 before the small radius 106 between this lead surface and the forming surface 19*a* on the form roll exerts force on the metal wrapped around the corresponding small radius 108 of the slide roll 19' in the manner discussed more fully below. Therefore, the cam follower surface 104 on the cam ring 102 is disposed in a plane P parallel to the plane P' of the slide roll chamfer 19*a* (FIG. 6 only) and is spaced forwardly therefrom by approximately the initial metal thickness. The cam ring 102 is fastened to the slide roll 19' and rotates and moves with it. Rearward axial displacement of the cam ring 102 is transmitted to the slide roll 19' by the forming roll 11 via nesting engagement of the rear face 102*a* of the cam ring against an annular mounting flange 110** projecting radially outwardly from the rear portion of the slide roll.

Slide roll 19' is a cylindrical sleeve with a conical end 19' over which the open end 20 of the container is positioned by the movement of the base pad. The slide roll 19' is supported by a rotating mandrel driven by the main drive at the same rotative speed as the base pad assembly.

The eccentric roll 24 is a cylindrical roll which is smaller than the final neck diameter of the container. The working surfaces are the cylindrical outside diameter 25, the conical surface **24*e* and the connecting radius 124. The conical angle of 24*e*** determines the cone angle that is formed on the container.

The form roll 11 is a cylindrical roll with a profiled outside diameter that forms the entire outside surface of the container neck area. It is free to rotate on an axis and is biased against a stop 126 with a light spring 127. It is free to slide toward the open end of the container 10 against the light spring pressure. The axis on which it rotates is moved toward the container 10 to force the form roll 11 into contact with the container. It is free to seek an equilibrium position between the eccentric roll 24 and the cam ring/slide roll assembly.

The construction and operation of the cam controlled interaction between the form roll 11 and slide roll 19' is best understood through a sequential description of the spin flow necking process. Initially, with reference to FIG. 4, the container bottom 14 is loaded onto the base pad assembly 29 which retains the container 10 by vacuum applied in a known manner through a central hole 114. The container 10 is located on a raised circular plug 116 inside the countersink diameter of the bottom. An airtight seal is maintained on the outside tapered surface of the container bottom 14 with an elastic seal 118. The base pad assembly 29 is axially movable to advance the container into the tooling for forming and to remove the finished can for transfer to a flanging operation. The base pad assembly 29 dwells at both ends of its motion and has no axial movement during the forming process. The base pad is rotated by a main drive (not shown) and provides most of the rotative force on the container during the forming process. The main drive may also rotate the necking spindle assembly to ensure synchronous co-rotation.

In FIG. 4, the base pad 29 is in the load position with a container 10 in place on the pad. The eccentric roll 24 is concentric with the slide roll 19'. The slide roll 19' is against the forward stop 122 and the form roll assembly is in the 'out' position.

Figure 5:
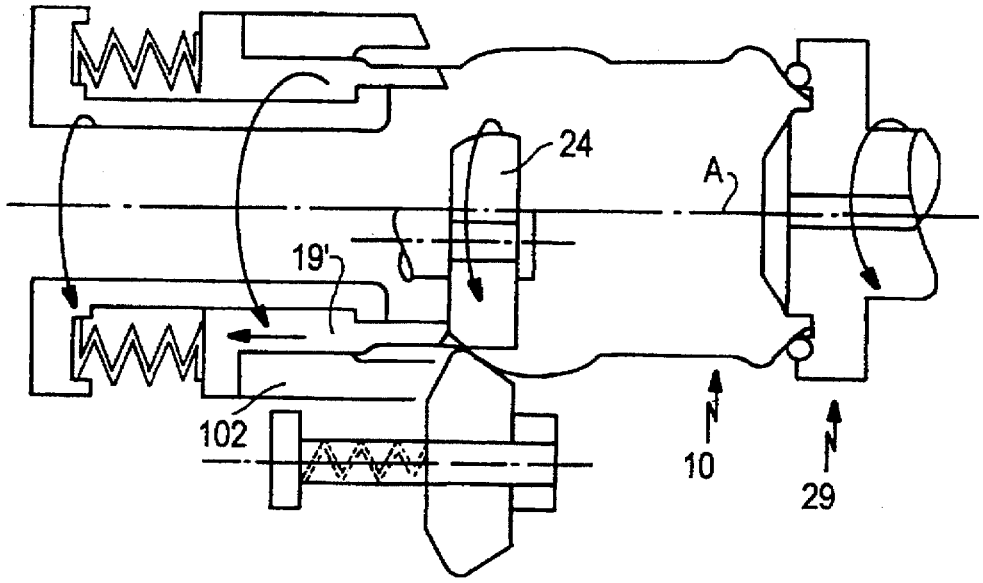
FIG. 5 is a schematic representation similar to FIG. 4 depicting the form roll radially inwardly moved into initial contact with the container side wall to be necked.

With reference to FIG. 5, the base pad assembly 29 has moved the container 10 onto the slide roll 19' and the eccentric roll 24 has rotated to contact the container at the open end. The form roll 11 has moved toward the container 10 and the form roll radius has contacted the container at the pre-neck location thereon. At this point, the rotating container 10 has also started both the eccentric roll 24 and form roll 11 to rotate.

Figure 6:
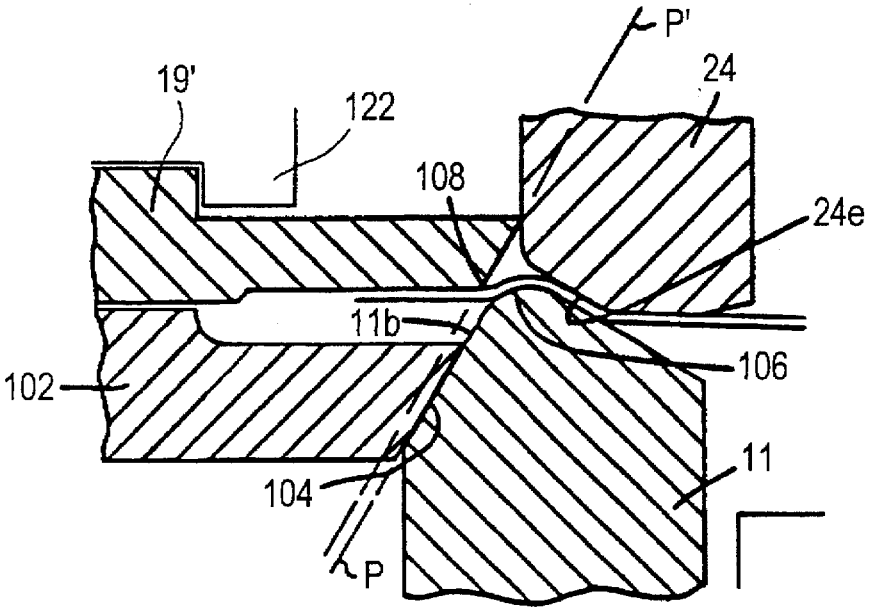
FIG. 6 is an enlarged, detailed sequential view depicting the relative locations of the tooling components at the onset of necking.

In FIG. 6, the form roll axis has moved radially inwardly closer to the container axis and has started to form the neck. The conical surface **24*e* on the eccentric roll 24 has forced the form roll 11 toward the open end 20 of the container 10**.

The form roll 11 has just touched the cam follower surface 104. The small radius 106 on the form roll 11 is very close to the small radius 108 on the slide roll 19' but does not pinch the metal between these two points. This is because the cam ring follower surface 104 is positioned so these radii 106, 108 may approach each other but stay separated by a distance slightly greater than the initial side wall thickness. This is presently understood to be a key feature in the elimination of metal exposure and neck cracks caused by excessive contact pressure between the two small radii 106,108 in the uncontrolled collision of the form roll 11 with the metal wrapped around the small radii 108 on the slide roll 19 in the prior spin flow necking process described hereinabove. In other words, since the form roll 11 contacts the cam follower surface 104 as the two radii 106,108 approach, such contact results in retraction or rearward axial sliding movement of the slide roll 19' which permits the two radii to move past each other.

Figure 7:
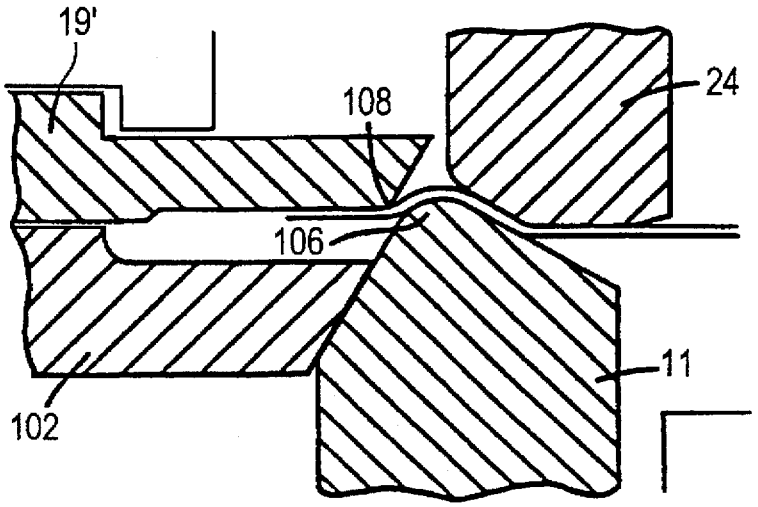
FIG. 7 is a view similar to FIG. 6 sequentially depicting further relative positioning of the tooling components as necking continues.

In FIG. 7, the form roll 11 has penetrated further between the eccentric roll 24 and the slide roll 19'. The small radius 106 on the form roll 11 is just passing the small radius 108 on the slide roll 19'. The rolls 11,19' do not pinch the metal but have moved closer. As mentioned above, the form roll 11 is forcing the slide roll 19' back by contact between the form roll and the cam ring 102 instead of contact at this point between the form roll and the slide roll as occurred in the aforesaid prior spin flow necking process.

Figure 8:
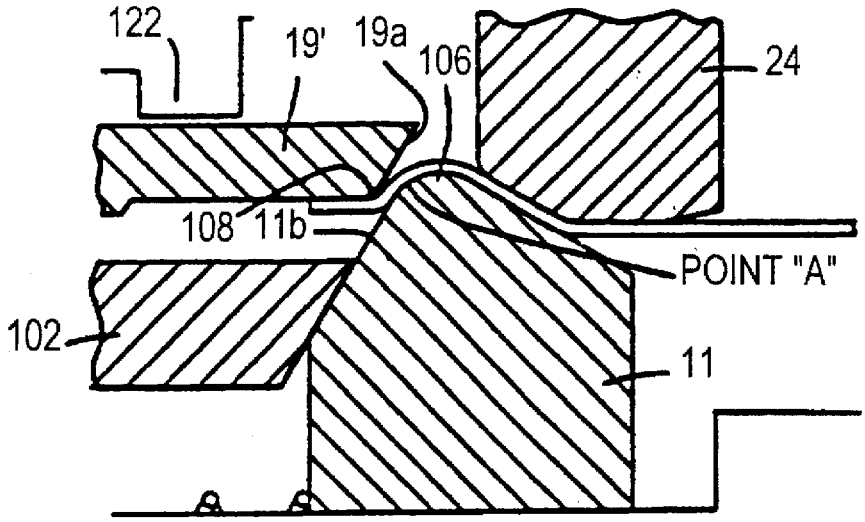
FIG. 8 is similar to FIG. 7 depicting further sequential positioning of components.

In FIG. 8, the form roll 11 has continued its penetration and the small radius 106 is past the small radius 108 on the slide roll 19' (point A). At this point, the conical surfaces 19*a*,11*b* on the slide roll and the form roll, respectively, are opposite and parallel each other. The slide roll 19' and cam ring 102' have been pushed to the left in FIG. 9. The combination of the metal thickening as a result of being squeezed between the form roll 11 and the eccentric roll 24 as the metal wraps around the forming surface 11*a* of the form roll, and the shape of the left or trailing conical surface 11*b* on the form roll, has reduced the relative clearance between the form roll and the slide roll so that the form roll is now actually putting slight pressure on the metal.

Figure 9:
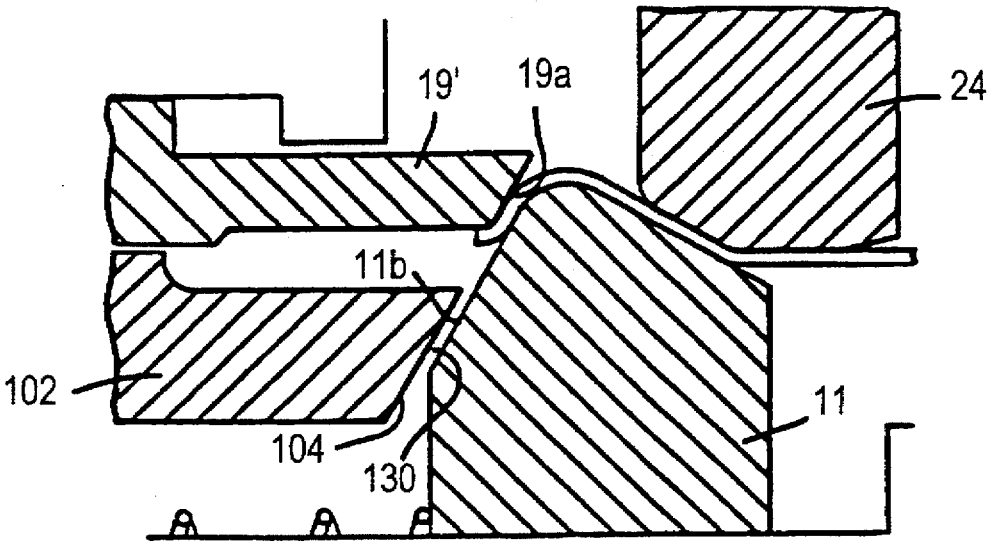
FIG. 9 is a view similar to FIG. 8 depicting still further sequential positioning.

In FIG. 9, the form roll 11 has now penetrated further into the gap between the eccentric and slide rolls 24,19'. The form roll 11 is clearly clamping the metal between it and the slide roll 19' and, as a result, a gap 130 has opened up between the form roll surface 11b and the cam ring follower surface 104. The form roll 11 is now pushing the slide roll 19' directly in the axially rearward direction through its contact with the metal, and not through the cam ring 102. Since the small radii 106,108 between the form roll 11 and slide roll 19' have already "slipped" past each other without undesirable grooving of the metal therebetween, the direct interaction of the form roll in thinning and shaping the metal against the bias of the conical surface 19*a* on the slide roll is important to ensure proper necking and distribution of metal.

Figure 10:
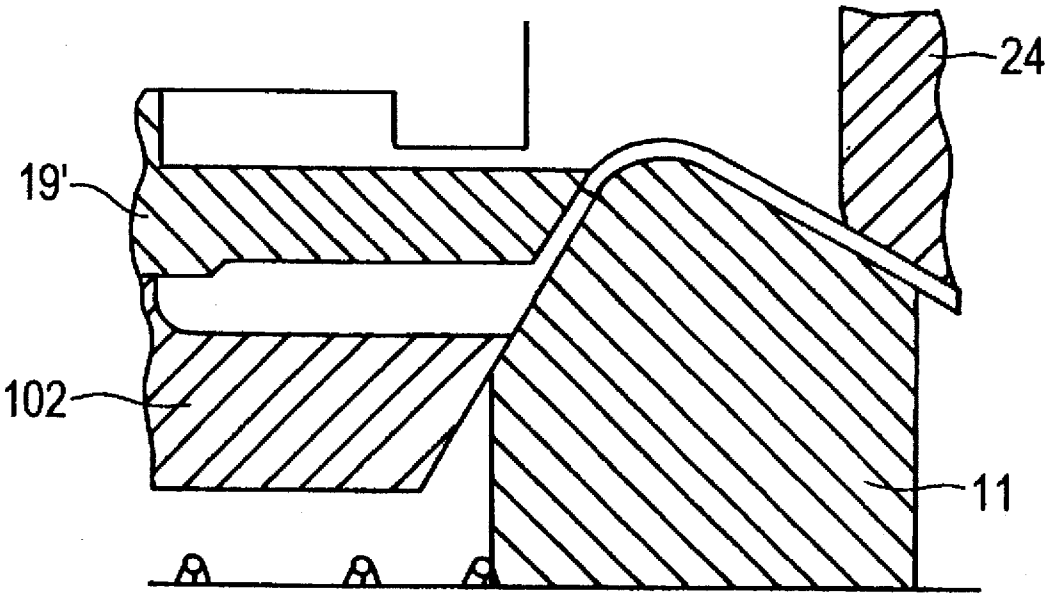
FIG. 10 is similar to FIG. 9 depicting the locations of the tooling components at the radially most inward position of the form roll.

In FIG. 10, the form roll 11 has now penetrated to its radially inwardmost position to complete the formation of the spin flow neck. During the entire forming process, between 20 to 24 revolutions of the container 10 are required, depending on the diameter, thickness and the amount of diameter reduction in the container end. The rolling contact between the form roll 11 and the slide roll 19' has thinned the edge of the flange slightly. Therefore, in accordance with a further feature of this invention, the form roll 11 now once again contacts the cam ring 102 to prevent further thinning of the flange area of the container 10, i.e., gap 130 has closed.

The spin flow necking process does not put the can in compression, as does static die necking or other similar processes. Hence, although the electromagnetic forming process of FIG. 2 reduces the column strength of the can, the spin flow necking process is not compromised. Furthermore, and advantageously, by first pre-necking the open end, followed by electromagnetic forming, it remains possible to neck in the container open ends to the commercially desirable smaller diameter otherwise achieved in non-contoured containers.

As an example of the process of the present invention, a trimmed can after the D&I process has a sidewall diameter $d_2$ of 2.475 inches. During the pre-necking processing of FIG. 2, the diameter of the open end 20, $d_2$, is reduced to 2.291. The electromagnetic forming process of FIG. 3 results in an expanded sidewall of 2.6 inches in diameter at the largest point. After spin flow necking, as depicted in FIG. 4, the inner diameter of the necked-in portion is reduced to 2.060.

It will be readily seen by one of ordinary skill in the art that the present invention fulfills all of the objects set forth above. After reading the foregoing specification, one of ordinary skill will be able to effect various changes, substitutions of equivalents and various other aspects of the invention as broadly disclosed herein. It is therefore intended that the protection granted hereon be limited only by the definition contained in the appended claims and equivalents thereof.

What is claimed is:

1. A method of manufacturing a metal container including a body having a bottom wall with a cylindrical sidewall extending therefrom and having an open end, the method comprising the steps of:

pre-necking the open end of the sidewall to form a reduced diameter section;

electromagnetic forming of the sidewall after the pre-necking to form an outwardly expanding contoured sidewall; and performing necking proximate the reduced diameter section to achieve a further reduced diameter conical necked end by radially inwardly advancing an external forming member into contact with the sidewall against counterpressure provided by a pair of relatively axially displaceable inner members disposed within the can interior.

2. The method of claim 1, further comprising the step of flanging the necked end of the can.

3. The method of claim 1, wherein the step of electromagnetic forming comprises the steps of:

placing the body inside a mold with the can bottom resting on a bottom surface of the mold;

placing a coil of electrically conductive material inside the body with the outer diameter of the coil adjacent inside surfaces of the sidewall;

removing air disposed between the body and the mold to create a vacuum; and energizing the coil to create an electromagnetic force sufficient to expand a portion of the sidewall located adjacent the coil outwardly into the mold.

4. The method of claim 3, wherein the outer diameter of the coil is less than the diameter of the reduced diameter section.

5. The method of claim 1, wherein the step of pre-necking is formed by a die necking process.

6. The method of claim 5, wherein the die necking process comprises the steps of:

conveying the can through at least one station;

at said at least one station, reciprocating a die ring into contact with the open end while the can bottom is non-rotatably secured.

7. The method of claim 6, wherein the can is conveyed through a number of stations where, at each station, a die ring of a progressively smaller diameter is reciprocated into contact with the open end while the can bottom is non-rotatably secured.

8. The method of claim 1, wherein the step of necking to achieve a further reduced diameter conical necked end is performed by spin flow necking.

9. The method of claim 8, wherein the step of spin flow necking comprises:

positioning the can with the can bottom in contact with a base spindle assembly and the open end on a necking spindle assembly;

spinning the body by rotating the necking and base spindle assemblies about a common axes of rotation; and moving an external free roll inwardly and axially against the open end against a spring loaded holder supporting the interior wall of the can to form the conical necked end, the holder being free to move axially under the forming force of the free roll.

10. The method of claim 9, wherein the can is positioned with the can bottom in suction contact with the base spindle assembly.

11. The method of claim 1, wherein, prior to the step of electromagnetic forming, the method includes the step of printing an outer surface of the sidewall.

12. The method of claim 1, wherein, prior to the step of electromagnetic forming, the method includes the step of coating an inner surface of the body.

13. The method of claim 1, wherein, prior to the step of pre-necking, the method includes the step of coating an inner surface of the body.

14. The method of claim 1, wherein, prior to the step of pre-necking, the method includes the step of varying the thickness of the sidewall.

15. The method of claim 14, wherein the thickness of the sidewall is varied during the drawing and ironing process by tapering the punch.

16. A method of manufacturing a metal container including a body having a bottom wall with a cylindrical sidewall extending therefrom and having an open end, the method comprising the steps of:

pre-necking the open end of the sidewall to form a reduced diameter section;

electromagnetic forming the sidewall after the pre-necking to form an outwardly expanding contoured sidewall; and performing necking to achieve a reduced diameter conical necked end by radially inwardly advancing an external forming member into contact with the sidewall against counterpressure provided by a pair of relatively axially displaceable inner members disposed within the can interior.

17. The method of claim 16, further comprising the step of flanging the necked end of the can.

18. The method of claim 16, wherein the step of electromagnetic forming comprises the steps of:

placing the body inside a mold with the can bottom resting on a bottom surface of the mold;

placing a coil of electrically conductive material inside the body with the outer diameter of the coil adjacent inside surfaces of the sidewall;

removing air disposed between the body and the mold to create a vacuum; and energizing the coil to create an electromagnetic force sufficient to expand a portion of the sidewall located adjacent the coil outwardly into the mold.

19. The method of claim 18, wherein the outer diameter of the coil is less than the diameter of the reduced diameter section.

20. The method of claim 16, wherein the step of necking is performed by spin flow necking.

21. The method of claim 20, wherein the step of spin flow necking comprises:

positioning the can with the can bottom in contact with a base spindle assembly and the open end on a necking spindle assembly;

spinning the body by rotating the necking and base spindle assemblies about a common axes of rotation; and moving an external free roll inwardly and axially against the open end against a spring loaded holder supporting the interior wall of the can to form the conical necked end, the holder being free to move axially under the forming force of the free roll.

22. The method of claim 21, wherein the can is positioned with the can bottom in suction contact with the base spindle assembly.

23. The method of claim 16, wherein, prior to the step of electromagnetic forming, the method includes the step of printing an outer surface of the sidewall.

24. The method of claim 16, wherein, prior to the step of electromagnetic forming, the method includes the step of coating an inner surface of the body.

* * * * *